US007083046B2

(12) United States Patent
Bakx

(10) Patent No.: US 7,083,046 B2
(45) Date of Patent: Aug. 1, 2006

(54) WRAPAROUND CARTON AND BLANK

(75) Inventor: Martinus C. M. Bakx, Zeeland (NL)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/638,236

(22) Filed: Aug. 7, 2003

(65) Prior Publication Data

US 2004/0079666 A1 Apr. 29, 2004

Related U.S. Application Data

(63) Continuation of application No. PCT/US02/03692, filed on Feb. 7, 2002.

(30) Foreign Application Priority Data

Feb. 7, 2001 (GB) ..... 0103023

(51) Int. Cl.
*B65D 75/00* (2006.01)

(52) U.S. Cl. ..... 206/434; 206/427; 206/158; 294/87.2

(58) Field of Classification Search ..... 206/150, 206/151, 152, 153, 154, 155, 156, 157, 159, 206/427, 429, 434; 229/103.2; 294/87.2
See application file for complete search history.

(56) References Cited

U.S. PATENT DOCUMENTS 1,782,429 A 11/1930 Johnson
2,950,041 A 8/1960 Stone
3,001,647 A 9/1961 Liss
3,166,190 A 1/1965 Conrades
3,189,215 A 6/1965 Currie, Jr.
5,549,197 A * 8/1996 Sutherland ..... 206/158
5,639,137 A * 6/1997 Bakx ..... 294/87.2
5,820,185 A * 10/1998 Gomes ..... 294/87.2
6,158,586 A * 12/2000 Muller ..... 206/427
6,488,322 B1 * 12/2002 Bakx ..... 294/87.2

FOREIGN PATENT DOCUMENTS

| | | |
|---|---|---|
| CA | 716427 | 8/1965 |
| DE | 3321036 A1 | 1/1984 |
| DE | 3711322 C1 | 5/1988 |
| EP | 0048506 A1 | 3/1982 |
| EP | 0285043 A1 | 10/1988 |
| EP | 0997388 A2 | 5/2000 |
| FR | 1489093 | 5/1966 |
| FR | 2579958 | 10/1986 |
| GB | 2158037 | 11/1985 |

* cited by examiner

*Primary Examiner*—David T. Fidel
(74) *Attorney, Agent, or Firm*—Tsugihiko Suzuki

(57) ABSTRACT

A wraparound article carrier and a blank for forming a wraparound article carrier for packaging an article such as a pot of foodstuffs is disclosed. The carrier comprises opposed top and base walls interconnected by opposed side walls thereby forming a tubular structure. An aperture is provided in the base wall panel to accommodate a portion of the article. A bracing tab is formed at least in part from the base wall to define the aperture and folded so as to form a spacer for causing the top and base to be spaced by a predetermined distance.

6 Claims, 7 Drawing Sheets

WRAPAROUND CARTON AND BLANK

This is a continuation of international application No. PCT/US02/03692, filed Feb. 7, 2002, which is hereby incorporated by reference.

BACKGROUND OF THE INVENTION

The present invention relates to a wraparound carton and blank. More particularly, the invention relates to a wraparound carton and blank for packaging articles such as pots of foodstuff, for example yoghurt, in which the base of the article protrudes through an aperture in the base of the carton.

It is known to provide wraparound cartons for packaging such articles.

In U.S. Pat. No. 2,926,781 to Dickhens et al it discloses a carton for packaging a pair of articles such as food jars in which a pair of apertures is provided through which the top of the jars may protrude, the blank being further provided with apertures in the side walls through which the jar labels may be viewed.

U.S. Pat. No. 3,189,215 to Currie discloses a wraparound carton for packaging bottles, slotted apertures extending across the width of the top wall and being arranged to accommodate the necks of two bottles.

When erecting wraparound cartons which a portion of the article or articles to be packaged is capable of protruding through one of the carton walls, it is often difficult to ensure that the carton is erected with side walls of the same height, when the ends of the blank are side walls to be secured together and so that the top and base walls of the carton are parallel.

The present invention seeks to overcome or at least mitigate the problems of the prior art.

SUMMARY OF THE INVENTION

A first aspect of the present invention provides a wraparound article carrier for packaging an article such as a pot of foodstuffs, for example, the carton comprising opposed top and base walls interconnected by opposed side walls thereby forming a tubular structure. An aperture is provided in the base wall panel to accommodate a portion of the article. A bracing tab is struck from the aperture and folded so as to act as a spacer, thereby causing the top wall and base wall to be spaced by a predetermined distance.

Optionally, the bracing tab is struck from said base wall panel to define the aperture, the bracing tab extending into and hingedly connected to one of the panels forming the side wall. Preferably the one side wall panel is a securing flap which flap is secured to an outer side wall panel. The distance between the free edge of the securing flap and the fold line of the bracing tab is, preferably, less than the distance between the free edge and the fold line of the securing flap.

According to an optional feature of this aspect of the present invention the bracing tab extends to a flange of the article or to a panel opposed to the base wall panel.

A second aspect of the present invention provides a blank for forming a wraparound carrier for packaging an article such as a pot of foodstuffs, for example, the blank comprising a first top panel, a first side wall panel, a base wall panel and a second side wall panel hingedly connected together in series for forming a tubular structure. An aperture is provided in the base wall panel to accommodate a portion of the article wherein a bracing tab is struck from the aperture and so folded in a set up condition to act as a spacer thereby causing the top and base wall panels to be spaced by a predetermined distance. There may further comprise a securing flap hingedly connected to the base wall panel and wherein the bracing tab is struck from the base panel to define the aperture, the bracing tab extends into the securing flap and is hingedly connected to the securing flap.

According to an optional feature of the second aspect of the present invention the distance between the free edge of the securing flap and the fold line of the bracing tab is less than the distance between the free edge and the fold line of the securing flap.

A third aspect of the present invention provides a wraparound article carrier for packaging an article for example a primary carton, the carton comprising opposed top and base walls interconnected by first and second side walls so as to form a tubular structure. An aperture is struck from the base wall to receive a protruding portion of the article wherein the aperture extends into a panel adjacent the top wall so as to facilitate the folding of the top wall over the protruding portion during construction of the carton.

Optionally, the panel adjacent the top wall is a securing flap arranged to secure the top wall to one of said first or second side walls. Preferably the securing flap is disposed on the outside surface of the side wall and a portion of the side wall is disposed in the aperture to engage the article in the aperture.

According to a fourth aspect of the present invention there is provided a blank for forming a wraparound article carrier for packaging an article such as a sachet for example. The blank comprises in series a securing flap, a base wall panel, a first side wall panel, a top wall panel, and a second side wall panel. An aperture is struck from the base wall panel so as to receive a portion of the carton in use. The aperture extends into a securing flap so as to facilitate the folding of the base wall panel over the portion of the article during the folding of the blank to form a carton.

A fifth aspect of the present invention provides a method of forming a wraparound carton comprising a securing flap, a base wall panel, a first side wall panel, a top wall panel, a second side wall panel, hingedly interconnected in series so as to form a tubular structure, the top wall panel having an article receiving aperture struck therefrom and extending into the securing flap, the method comprising the steps of:

i) introducing the article to the carton;

ii) folding the base wall panel and securing flap about a fold line hingedly interconnecting the base wall panel and the first side wall panel; and iii) introducing the article into the portion of the aperture extending into the securing flap while folding the base wall and securing flap, thereby allowing the securing flap to clear the article.

Preferably, the method may further comprise the step prior to step (ii) of placing the article on the top wall panel and folding the base wall and second side wall around the article.

The method of the fifth aspect may further comprise the step of folding a bracing tab out of the plane of the base panel before the folding and introducing step, and the step of bringing the bracing tab into abutment on the top wall panel or on a portion (such as a top flange) of the article before folding the second side wall panel toward the securing flap.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
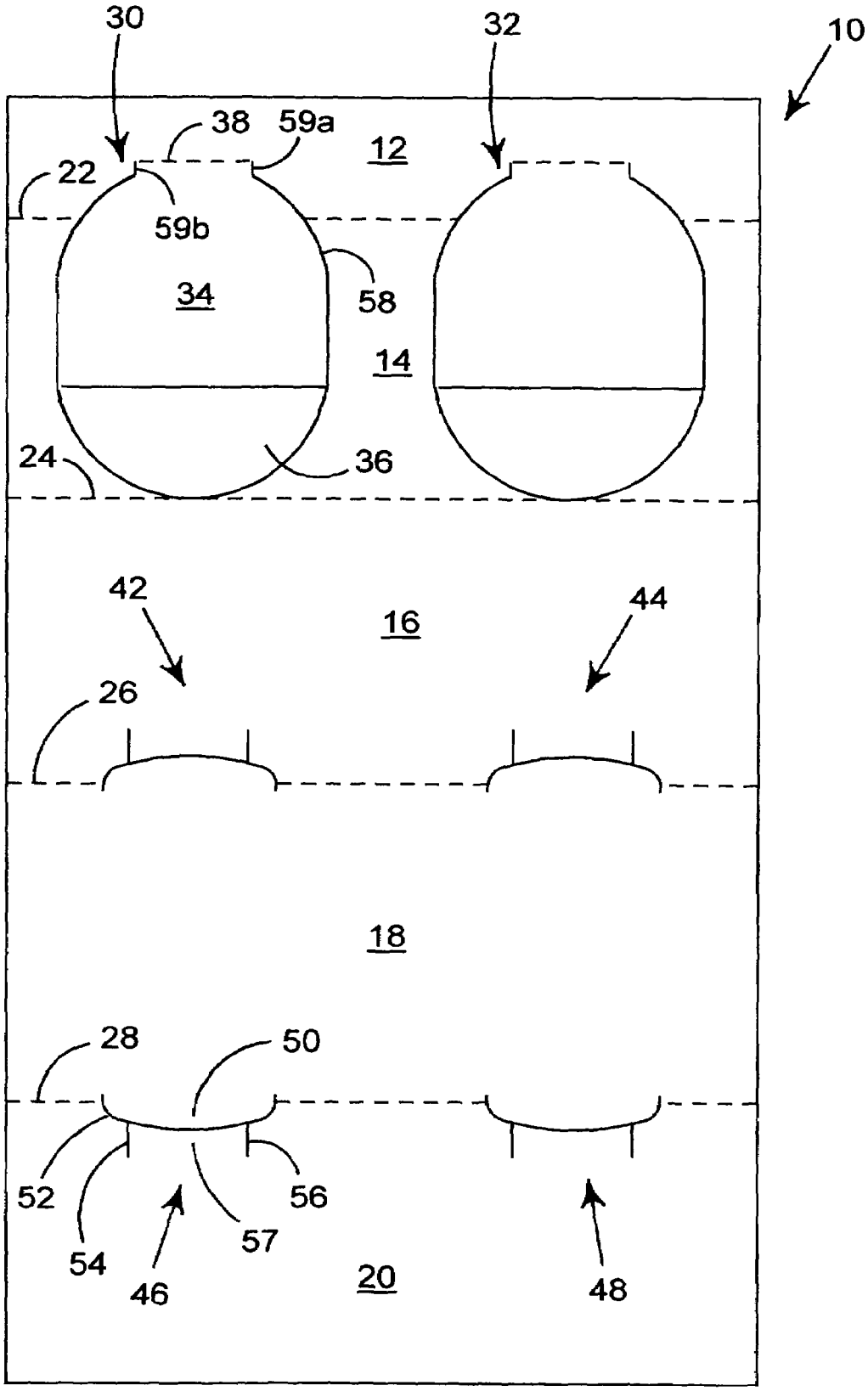
FIG. 1 is a plan view of a blank for folding a carton according to one embodiment of the present invention.

Referring to the first embodiment of the invention as illustrated in FIGS. 1 to 4 and in particular to FIG. 1, there is illustrated a blank 10 of paperboard or like foldable sheet material for forming a wraparound carton. There comprises a plurality of panels for forming a top wall, a base and opposed side walls. In this embodiment, the blank 10 comprises in series a base wall panel 14, first side wall panel 16, top wall panel 18 and second side wall panel 20 hingedly interconnected in series along fold lines 24, 26 and 28 respectively. Preferably, there further comprises an inner side wall panel or securing flap 12 hingedly connected to base wall panel 14 along fold line 20.

There may further comprise one or more aperture structures. In FIG. 1 there is shown a pair of aperture structures 30 and 32 are struck from base wall panel 14 and, in this embodiment, extends into securing flap 12. Each structure is substantially identical and therefore only aperture structure 30 is described in further detail.

There further comprises a spacer (or bracing) tab 34, struck from base wall panel 14 and extending into spacer flap 12 so as to interrupt fold line 22. Spacer tab 34 is hingedly connected to securing flap 12 by fold line 38. The tab is defined by cut line 58, with each end of cut line 58 being connected to fold line 38 by relatively short straight mutually parallel cut lines 59*a* and 59*b*. Of course, the position of the cut lines is non-limiting and in some embodiments cut lines 59*a* and 59*b* are dispensed with. The end of tab 34 remote from fold line 38 is, in this embodiment, substantially parallel to fold line 38 so as to define a portion to engage the flange of an article or a panel of the article carrier.

Opposed pairs of article retention structures 42, 44; 46, 48 are preferably provided along fold lines 26 and 28 respectively, the structures being arranged so as to interrupt the aforesaid fold lines. Each retention structure is substantially identical, and therefore only structure 46 is described in further detail. It can be seen from FIG. 1 that structure 46 comprises a protruding portion 50 of top wall panel 18 arranged so as to interrupt fold line 28 and being defined by curved cut line 52.

The structure further comprises a pair of spaced parallel cut lines 54 and 56 which is, in this embodiment, arranged substantially perpendicular to fold line 28, to extend from curved cut line 52 and terminates part way down second side wall panel 20. The cut lines 54 and 56 thereby define a tab portion 57.

It is envisaged that the carton of any of the embodiments of the present invention are formed by a series of sequential folding and gluing operations in a straight line machine so that the carton is not required to be rotated or inverted to complete its construction. The folding process is not limited to that described below and may be altered according to particular manufacturing requirements.

Figure 2:
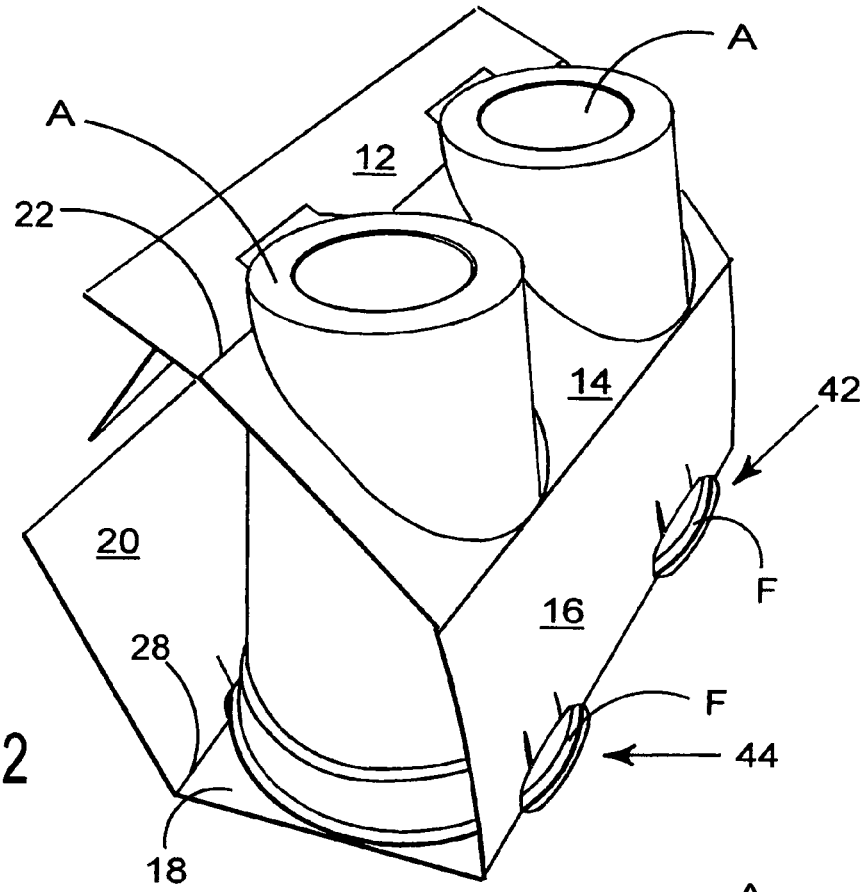
FIGS. 2 and 3 are perspective views of the blank of FIG. 1 during successive stages of the carton erection article loading procedure with the carton and articles inverted.

It can be seen from FIG. 2, in which the carton and articles A are inverted for the sake of clarity, that top wall panel 18 is placed so as to overlie the planar top face of the articles A. All references to directions are to be understood as if the blank and articles are in an upright state. Top wall panel 18 is dimensioned, in this embodiment, such that flange portions F of the articles A extend beyond fold lines 26 and 28.

Spacer tabs 34 are then folded downwardly out of alignment with securing flap 12 thereby revealing aperture 36 completely. Subsequently, first side wall panel 16 is folded inwardly out of alignment with top wall panel 18 and base wall panel 14 is folded inwardly and upwardly about fold line 24 out of alignment with first side wall panel 16. The elongate nature of apertures 36 enables base wall panel 14 to fold over the base of articles A without fouling on securing flap 12.

Figure 3:
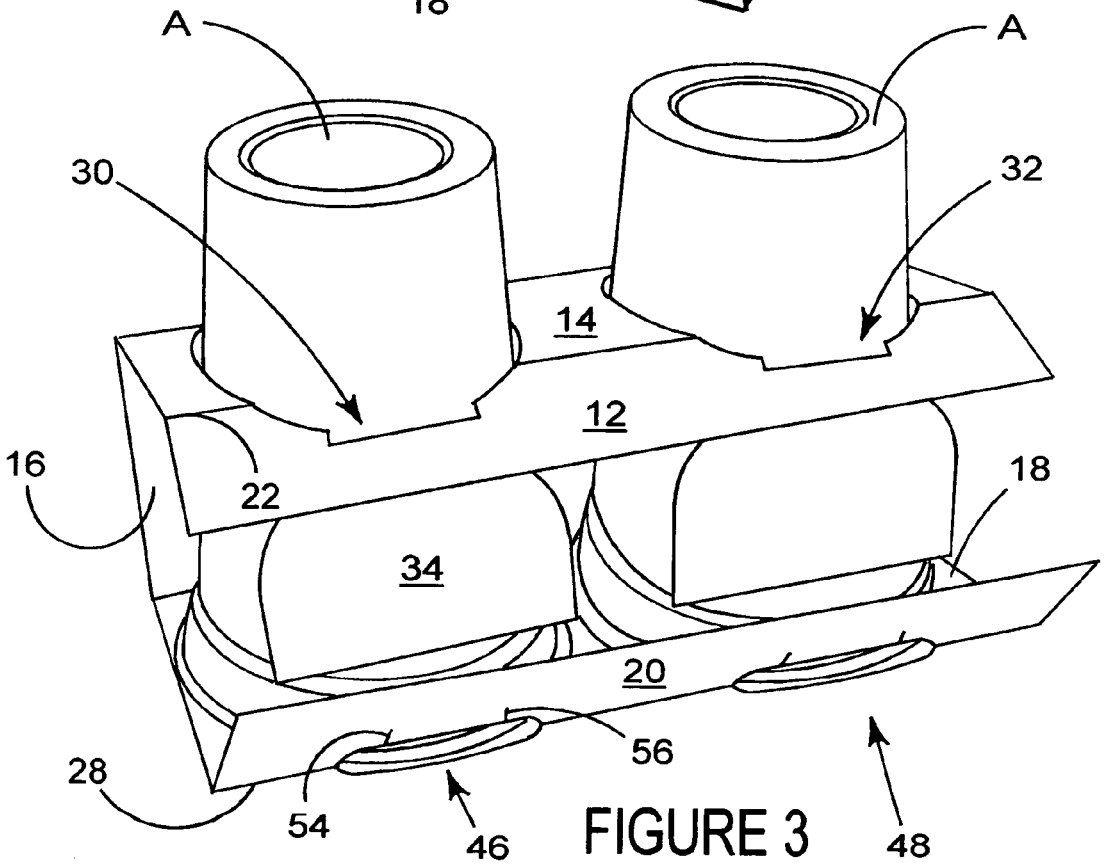

Subsequently, securing flap 12 is folded upwardly and inwardly about fold line 22 and second side wall panel 20 is folded downwardly and inwardly about fold line 28 as shown in FIG. 3. Thus, spacer tabs 34 are guided between second side wall panel 20 and the side of the respective article A and are thus brought into engagement with the under side of flange portions F of the articles A to restrict relative movement of the article A shown in FIG. 4*b*. In some embodiments, the outer face of securing flap 12 is brought into face contacting relationship with the inner face of second side wall panel 20. Panels 12 and 20 are preferably secured together using glue or other suitable means known in the art.

Figure 4A:
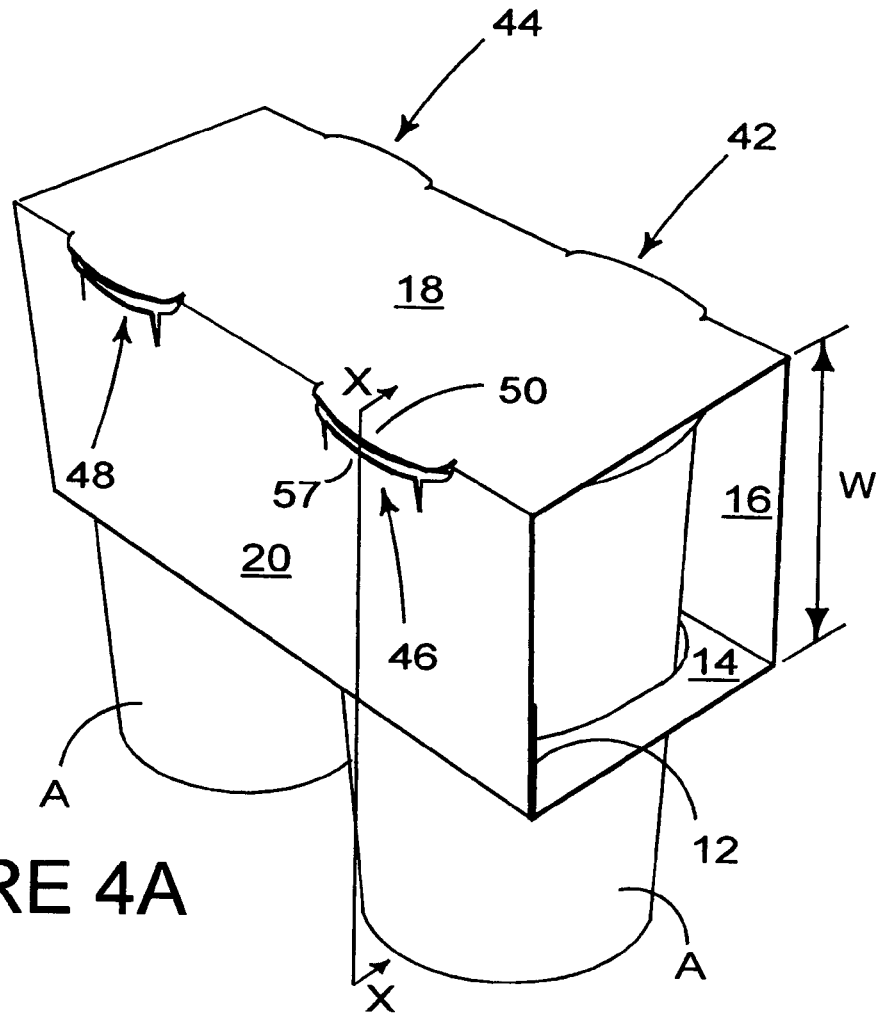
FIG. 4*a* is a perspective view of the carton formed from the blank of FIG. 1 in a fully set-up and loaded condition.
Figure 4B:
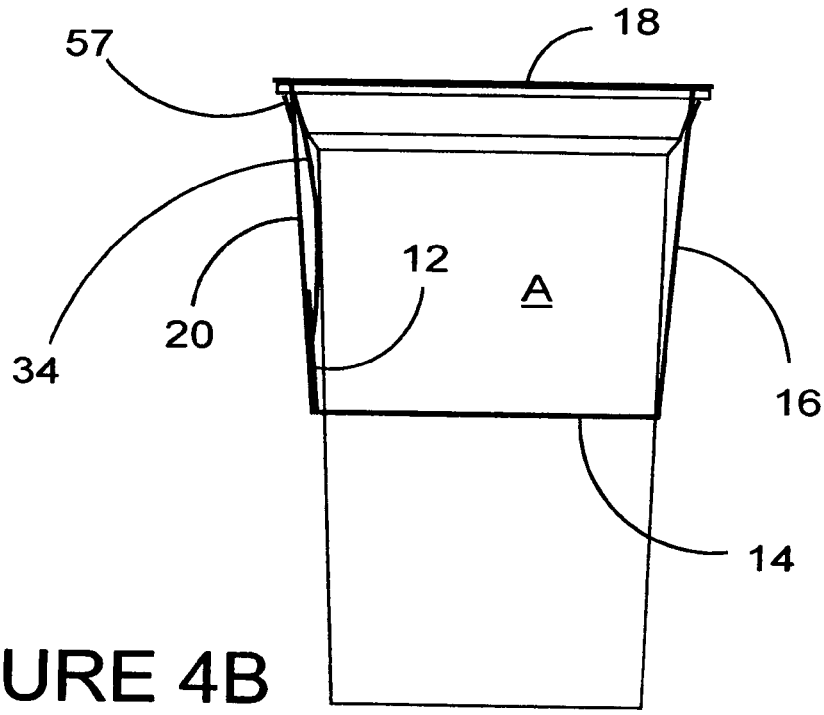
FIG. 4*b* is a cross section view of the carton shown in FIG. 4*a* through X—X.

The inward folding of first and second side wall panels 16 and 20 causes flange portions F to protrude laterally beyond fold lines 26 and 28 and the thickness of the flange portions causes tabs 57 to fold outwardly slightly beyond the plane of first and second side wall panel 20. The tabs 57 thereby engage underneath the flanges F, shown in FIGS. 4*a* and 4*b*, and assist in the retention of the articles A within the carton. The carton is now in a fully set-up and loaded condition as illustrated in FIG. 4.

It will be apparent that spacer tabs 34 are dimensioned such that during the folding operation, their positioning underneath flanges F ensures that the free edge of second side wall panel 20 is substantially co-extensive with fold line 28 when securing flap 12 is brought into face contacting relationship with second side wall panel 20, thus ensuring that, in this embodiment, base and top wall panels 14 and 18 are substantially parallel because the first side wall 16 is the same width W as the resulting second wall formed by securing flap 12 and second side wall panel 20. The alternative arrangement of achieving such a parallel arrangement with a relatively small engagement flap requires the flap to be secured to the outer face of second side wall panel 20. The disadvantage of such an arrangement is that the side wall surface is interrupted and therefore the display of information and/or advertising indicia is compromised.

In other embodiments, the free edge of spacer tab 34 may abut the inner surface of the top panel to achieve the same effect. This is particularly useful for articles without flanges. It is not necessary for the free edge of side wall panel 20 to be co-extensive with fold line 22, for example where the side wall panel is narrower and securing flap is wider, then the spacer tab would be used to determine the position of overlap for the securing flap and second side wall panel.

Figure 5:
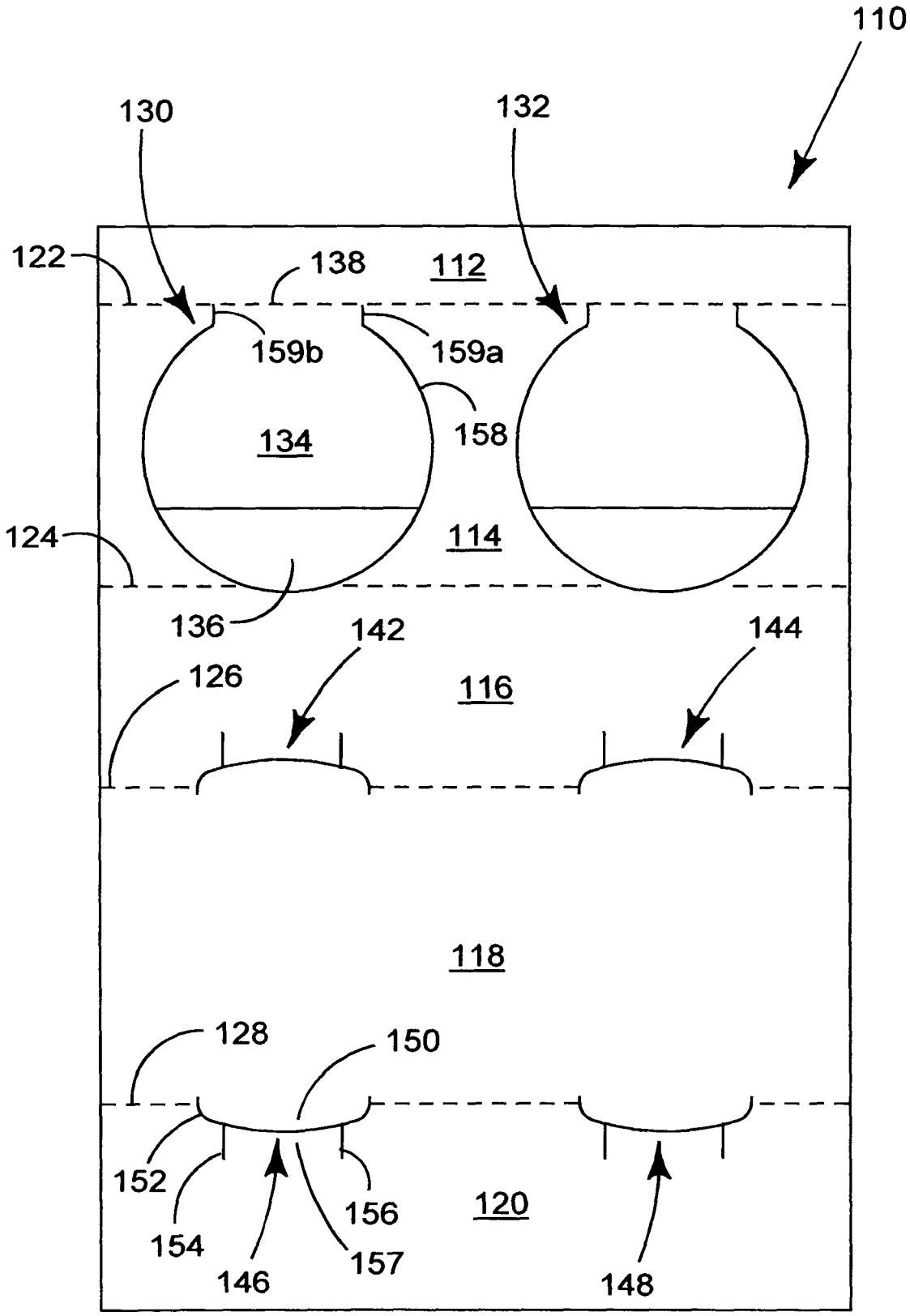
FIG. 5 is a blank for forming a carton according to a second embodiment of the present invention.
Figure 6:
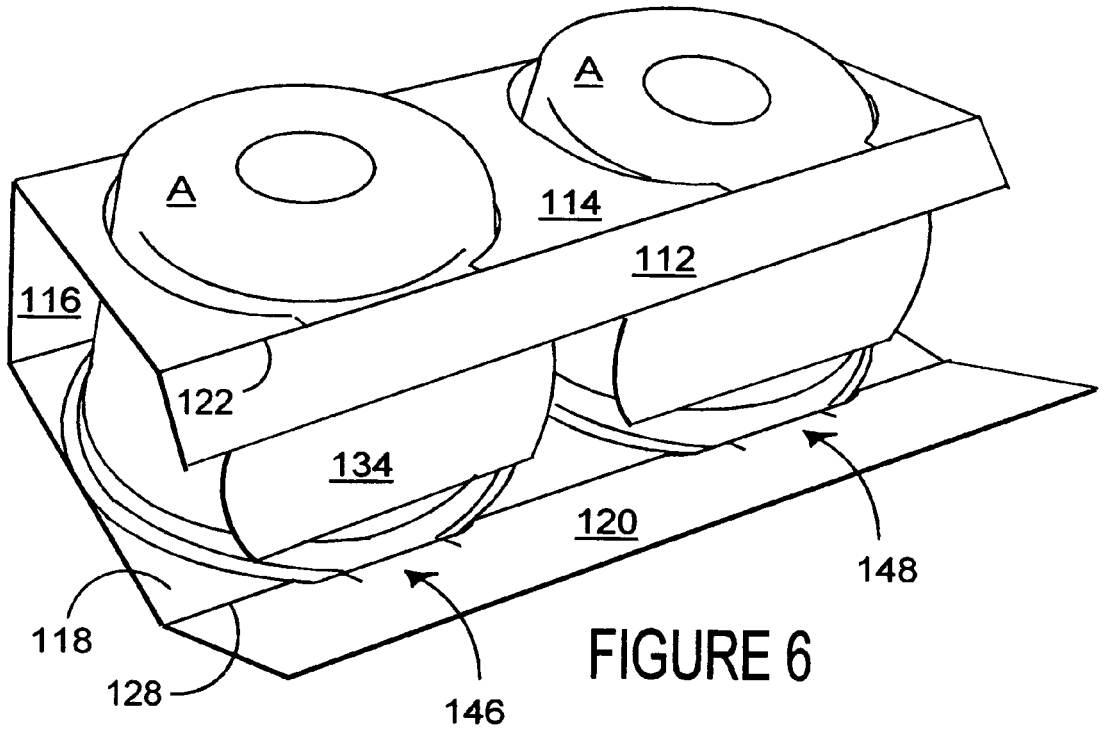
FIG. 6 is a perspective view of the blank of FIG. 5 illustrating one stage of the carton erection procedure with the carton and articles in an inverted state.
Figure 7:
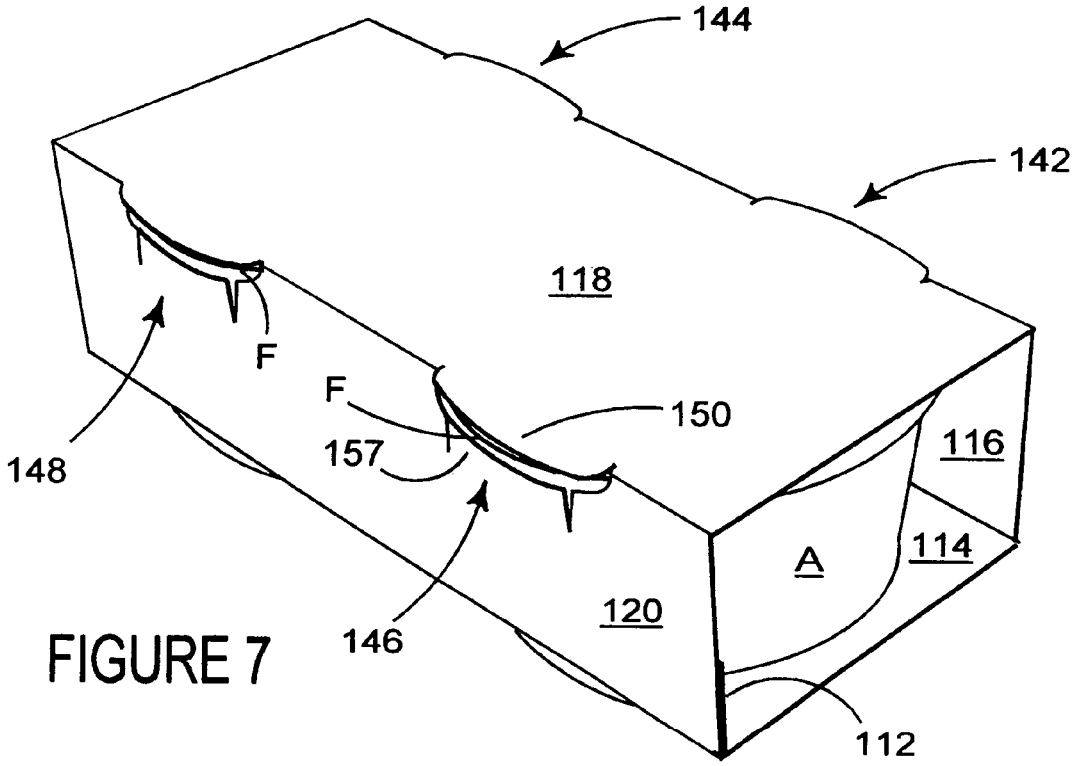
FIG. 7 is a perspective view of the carton formed from the blank of FIG. 5 in a fully set-up and loaded condition.

Turning now to the second embodiment of the invention as illustrated in FIGS. 5 to 7 and in particular to the blank as shown in FIG. 5, the first and second embodiments are similar and therefore like numerals have, where possible, been used for like parts where possible with the addition of the prefix "1". Only the differences between the second embodiment in relation to the first have therefore been described below.

The second embodiment of FIG. 5 differs from the first embodiment largely in relation to the aperture structures. In this embodiment, due to the shallower nature of the articles A, the aperture structures 130 and 132 are contained entirely within the base wall panel as it is not necessary for the apertures 136 to be elongate to prevent securing flap 112 fouling on the base of the article A.

As can be seen from FIG. 6, the erection procedure is substantially identical to that of the first embodiment and, as before, tabs 134 act as a spacer so as to ensure that the top and base walls of the erected carton are parallel as shown in FIG. 7.

Figure 8:
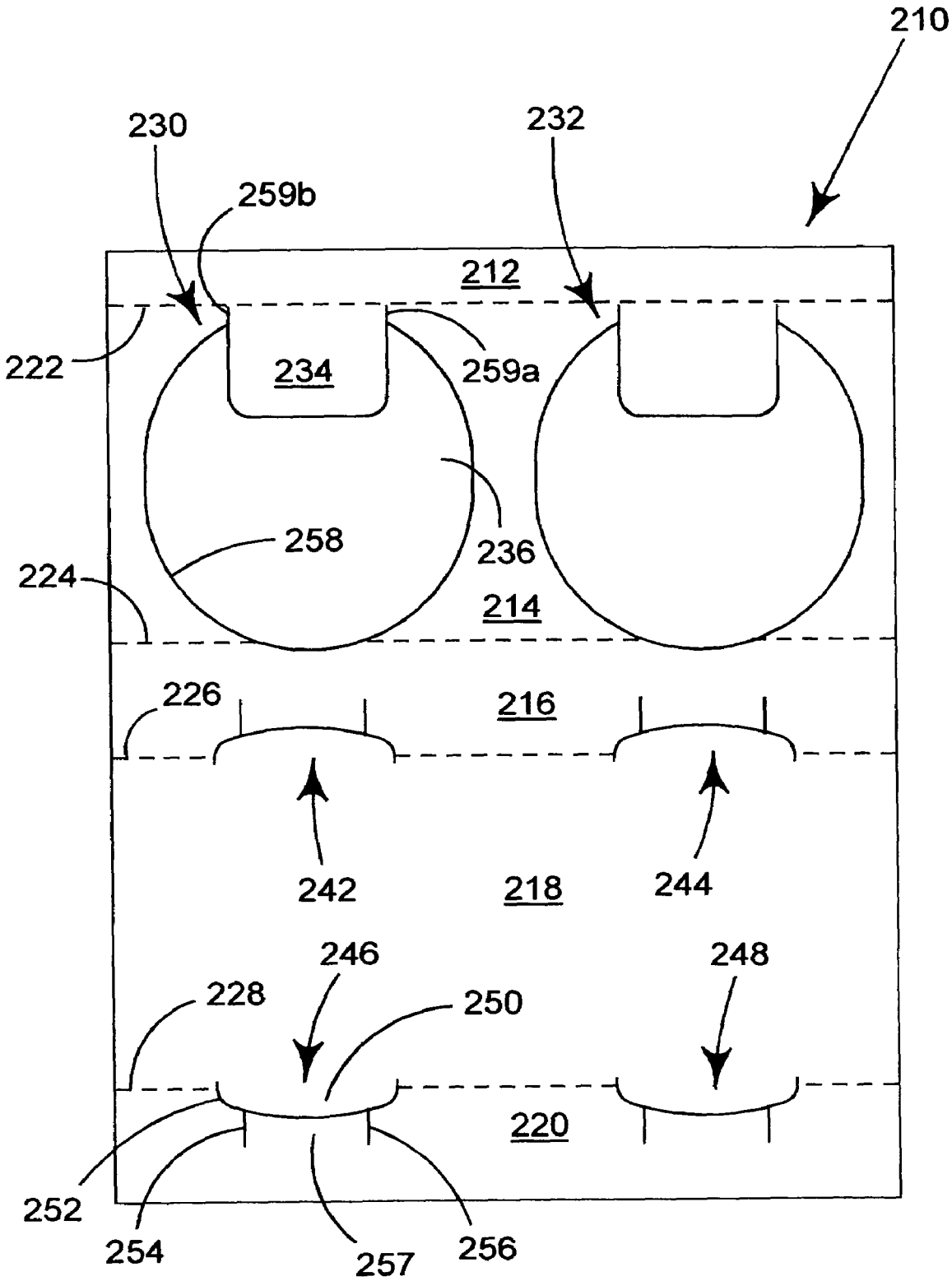
FIG. 8 is a plan view of the blank for forming a carton according to a third embodiment of the present invention.
Figure 9:
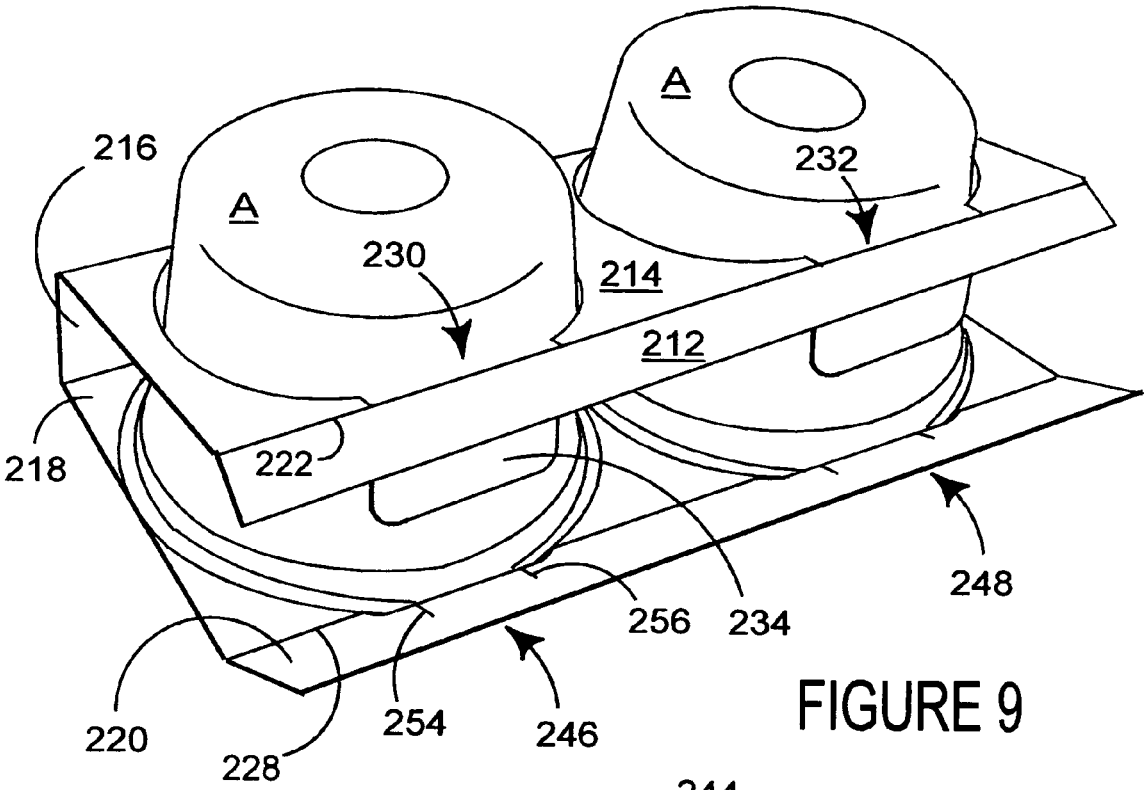
FIG. 9 is a perspective view of the blank of FIG. 8 at one stage of the carton erection procedure with the carton and articles shown in an inverted state.
Figure 10:
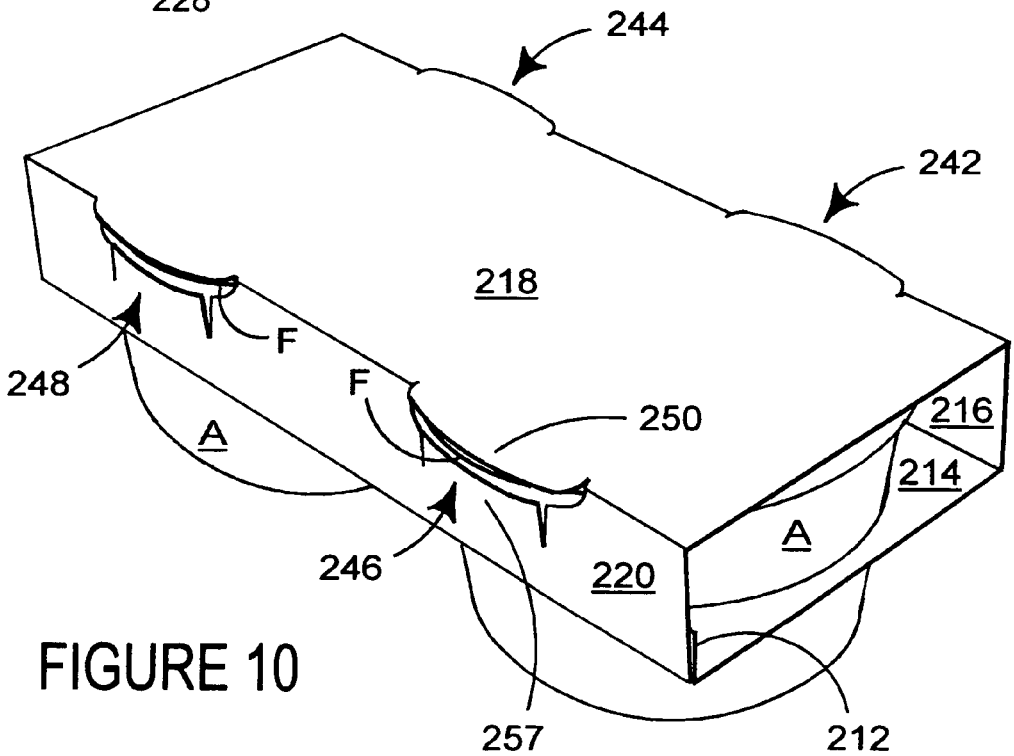
FIG. 10 is a perspective view of a carton formed from the blank of FIG. 8 in a fully set-up and loaded condition.

Turning now to the third embodiment of the invention as illustrated in FIGS. 8 to 10 and in particular to the blank as shown in FIG. 8: again the blank of the third embodiment is similar to the first embodiment and like numerals have where possible been used for like parts where possible with the addition of the prefix "2". Only the differences between the third embodiment in relation to the first have therefore been described below.

As can be seen from FIG. 8, the blank of FIG. 8 differs from that of FIG. 5 in that spacer tab 234 does not follow the cut line 258 defining aperture 236 rather the side edges thereof are defined by extensions of cut lines 259*a* and 259*b*.

The erection procedure of the blank to form the completed carton of the third embodiment is substantially identical to the erection procedure of the first and second embodiments and is shown in FIG. 9. The fully set-up and loaded carton formed from the blank of FIG. 8 is shown in FIG. 10.

It is envisaged the invention can be applied to a wrap-around carton or an end loading carton with only minor amendments to the structure. For example, the bracing tab could be struck entirely from the securing flap in those cartons without article apertures. The width of the securing flap (and therefore the bracing tab) can be adjusted according to the size of the carton.

It will be recognised that as used herein, directional references such as "top", "base", "end", "side", "upper", "lower", "inner" and "outer" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that numerous changes may be made within the scope of the invention. For example, the carton may be adapted to accommodate a single article or more than two articles. However the size and shape of the apertures and panels may be adjusted according to the particular requirements of the articles to be packaged and other known article retention means may be employed. The present invention and its preferred embodiment relates to a carton which is shaped to provide satisfactory rigidity to hold items such as primary containers securely but with a degree of flexibility. The shape of the blank minimises the amount of paperboard required for the carton. The items can be applied to the carrier by hand or automatic machinery. It is anticipated the invention can be applied to a variety of carton or tray types and not limited to those of the wrap-around sort.

What is claimed is:

1. A wraparound article carrier for packaging an article, the carton comprising opposed top and base walls interconnected by opposed side walls thereby forming a tubular structure, wherein an aperture is provided in the base wall to accommodate a portion of the article, wherein a bracing tab is formed at least in part from the base wall to define the aperture and folded so as to form a spacer for causing the top and base walls to be spaced by a predetermined distance, wherein the bracing tab is formed in part from one of said side walls and hingedly connected to said one of said side walls, wherein said one of said side walls comprises a securing flap and a side panel secured to the securing flap in face contacting relationship, said securing flap being hingedly connected to the base wall along a first fold line and extending toward the top wall to a free edge of the securing flap, said side panel being connected to the top wall and secured to said securing flap, said bracing tab being formed in part from said securing flap and hingedly connected to the securing flan along a second fold line, and wherein the distance between said free edge of the securing flap and said second fold line is less than the distance between said free edge and said first fold line.

2. An article carrier as claimed claim 1 wherein the bracing tab extends to the top wall or a portion of the article disposed adjacent to the top wall.

3. A blank for forming a wraparound carrier for packaging an article, the blank comprising a base wall panel, a first side wall panel, a top wall panel and a second side wall panel hingedly connected together in series for forming a tubular structure, and an aperture provided in the base wall panel to accommodate a portion of the article, wherein a bracing tab is formed at least in part from the base wall panel to define the aperture and so folded in a set up condition to form a spacer for causing the top and base wall panels to be spaced by a predetermined distance, the blank further comprising a securing flap hingedly connected to the base wall panel along a first fold line, wherein the bracing tab is formed in part from said securing flap and hingedly connected to the securing flap along a second fold line, wherein the distance between a free edge of the securing flap and said second fold line is less than the distance between said free edge and said first fold line.

4. A blank as claimed in claim 3, wherein the bracing tab is sized so as to extend to the top wall panel or to a portion of the article adjacent to the top wall panel in a set up condition.

5. A wraparound article carrier for packaging an article, the carton comprising opposed top and base walls interconnected by first and second side walls so as to form a tubular structure, and an aperture provided in the base wall so as to receive a protruding portion of the article, wherein the aperture extends into a panel adjacent the base wall so as to facilitate the folding of the base wall panel over the protruding portion during construction of the carton, wherein the panel adjacent the base wall is a securing flap hingedly connected to the base wall, said securing panel being secured to one of said first and second side walls in face contacting relationship to secure the base wall to the one of said first and second side walls.

6. A article carrier as claimed in claim 5, wherein the securing flap is disposed on the inside surface of the one of said side walls so that a portion of the aperture in the securing flap is covered by the one of said side walls.

* * * * *